US006231451B1

(12) United States Patent
Briggs

(10) Patent No.: US 6,231,451 B1
(45) Date of Patent: May 15, 2001

(54) METHOD OF INTERACTIVE PLAY

(76) Inventor: Rick A. Briggs, 64 Maple Grove, Springfield, IL (US) 62707

( * ) Notice: Subject to any disclaimer, the term of this patent is extended or adjusted under 35 U.S.C. 154(b) by 0 days.

(21) Appl. No.: 09/243,219

(22) Filed: Feb. 2, 1999

Related U.S. Application Data

(62) Division of application No. 08/831,388, filed on Apr. 1, 1997, now Pat. No. 5,865,680.
(60) Provisional application No. 60/024,427, filed on Aug. 21, 1996, now abandoned.

(51) Int. Cl.[7] ..... A63G 31/00
(52) U.S. Cl. ..... 472/128; 472/136
(58) Field of Search ..... 472/117, 128, 472/129, 136, 137; 273/395; 446/171

(56) References Cited

U.S. PATENT DOCUMENTS

| | | |
|---|---|---|
| D. 277,610 | 2/1985 | Arginsky . |
| D. 330,579 | 10/1992 | Briggs . |
| 1,935,543 | 11/1933 | Coughlin . |
| 3,170,171 | 2/1965 | Mayhew . |
| 3,601,397 | 8/1971 | Carlin et al. . |
| 4,037,355 | 7/1977 | Street . |
| 4,057,244 | 11/1977 | Gaspar . |
| 4,219,198 | 8/1980 | Meyer et al. . |
| 5,194,048 | 3/1993 | Briggs . |
| 5,226,864 | 7/1993 | Showers . |
| 5,256,120 | 10/1993 | Howell . |
| 5,343,849 | 9/1994 | Steer . |
| 5,378,197 | 1/1995 | Briggs . |
| 5,405,294 | 4/1995 | Briggs . |
| 5,431,410 | 7/1995 | Hampton . |
| 5,480,336 | 1/1996 | Blanchard . |
| 5,673,918 | 10/1997 | Bigari . |
| 5,709,581 | 1/1998 | Rothbarth et al. . |

OTHER PUBLICATIONS

SCS Interactive WaterPlay® Systems.

SCS Pirate Fortress Brochure.

SCS Caribbean Family Adventure Brochure.

SCS Discovery Treehouse Brochure.

Braunfelsbilt Products Brochure.

SCS Brochures Models 107–333 (Apr. 30, 1993).

SCS Brochure Model 400 (Nov. 15, 1994).

"The Pentes Playbill"—Newspaper of Pentes Play, Inc. Showtime 1995.

"The Pentes Playbill"—Newspaper of Pentes Play, Inc. Autumn 1995.

"The Pentes Playbill"—Newspaper of Pentes Play, Inc. Show Edition 1996.

"The Pentes Playbill"—Newspaper of Pentes Play, Inc. Spring 1997.

Pentes Play "Sampler Catalog".

*Primary Examiner*—Kien T. Nguyen

(57) ABSTRACT

A method of interactive play is provided for facilitating team-oriented or group interactive play to achieve a common desired effect. The method of play takes advantage of a number of play elements disposed at various locations and elevations throughout a play structure. Each play element is activated or operated by one or more play participants to complete one of several necessary steps in a chain of triggering events resulting in energy being transferred from one play element to the next. The overall completion of the chain of events results in a common desired result or effect, such as a domino-like cascade of various mechanisms, balls, water and/or the like. Play participants achieve the final goal through a collective team effort requiring the coordinated completion of several smaller objectives comprising each necessary step in the chain of triggering events.

20 Claims, 8 Drawing Sheets

METHOD OF INTERACTIVE PLAY

RELATED APPLICATIONS

This application is a divisional of U.S. application Ser. No. 08/831,388 filed Apr. 1, 1997, now U.S. Pat. No. 5,865,680, which is a continuation of U.S. Provisional Application Serial No. 60/024,427 filed Aug. 21, 1996, now abandoned.

BACKGROUND OF THE INVENTION

1. Field of the Invention

The present invention relates to interactive play structures, and, in particular, to a kinetic interactive play structure for entertaining and educating children and adults.

2. Description of the Related Art

There has been a recent proliferation of commercial play structures designed to meet the recreational needs of young families. Such play structures can provide a safe and exciting alternative to more traditional parks and playgrounds. Conventional play structures may be grouped into two general categories: "wet" play structures and "dry" play structures. In accordance with the respective grouping a play structure may utilize either corresponding wet or dry play media and play elements.

Typical dry play structures may include a padded framework and cushioned floors defining a variety of play elements and/or areas. Slides, tunnels, net bridges, and ladders may be used to interconnect the various play elements and play areas so that play participants can traverse from one play element or area to the next. A particularly popular dry play element is the conventional ball pit in which small, lightweight, hollow plastic balls fill an enclosed pen of a predetermined depth. Play participants jump into the pen and are partially or fully submerged in the balls. Play participants may also throw the balls in the air or at one another. Other typical dry play elements may include viewing towers, rope swings, soft hanging bags and rotating padded drums and the like. Typical wet play structures may include various devices for cooling and entertaining play participants using water. Several popular wet play elements include water slides, spray guns, spray hoses, waterfalls, sprinklers, buckets, and the like.

Most conventional play structures are "passive." That is, the various play elements are normally static or react only to forces imparted directly by the play participants. While passive play structures can be entertaining, they do not generally stimulate the development of creative thinking or problem solving abilities. It is preferred to provide a play structure that is "active" or "interactive" in order to allow play participants to operate and control any one of a number of play elements while observing and learning about the associated causes and effects. For example, my U.S. Pat. No. 5,194,048 and related design patent D330,579 first disclosed the concept of participatory or interactive waterplay in which play participants can operate any one of a number of valves to adjust the amount of water spraying from one or more associated water effects. Play participants adjust the various valves and can immediately observe the change in the quality, rate or direction of water produced by the associated water effect. Interactive play allows play participants to experiment with and learn about various cause-and-effect reactions using any one of a number of familiar and entertaining play mediums, such as water, balls, balloons or the like. Small children, particularly, can benefit from the fun learning experiences garnered from such interactive play activities.

Heretofore, the design of commercial interactive play structures has centered around providing many different interactive play elements which can be operated independently and simultaneously to achieve a variety of desired effects. While such play structures present the opportunity for group interaction, the elements of group cooperation and team work are not specifically encouraged. In fact, in many respects these play structures are designed to foster individual competitiveness amongst the various play participants rather than cooperativeness, with each play participant competing to douse other play participants with water or balls, or to strike a particular target or otherwise achieve a desired individual effect.

SUMMARY OF THE INVENTION

The present invention expands and improves upon my previous inventions by providing a fun and entertaining interactive play structure that not only stimulates the development of creative thinking and individual problem solving abilities, but which does so in a way that fosters and encourages group cooperation and team work to achieve a common goal.

The importance of encouraging teamwork and cooperation among young children cannot be understated, as it is the basis for any modern civilized society. It is an important purpose and object of the present invention, therefore, to provide an interactive play structure that allows play participants to experiment with and learn about various cause and effect reactions using a combination of familiar and entertaining play mediums in a manner that encourages and rewards group cooperation and teamwork to achieve a common goal.

It is a further purpose and object of the present invention to provide an interactive play structure which combines various elements and aspects of both wet and dry play structures in order to afford possibilities for play activities that incorporate the widest possible range of fun and exciting play media and mechanisms, such as balls, water, valves, springs, cams, pulleys, gears, cogs, baskets, buckets, water/air-powered devices, and the like, all of which can be employed to provide an interactive play experience that is both fun and educational.

In accordance with one embodiment the present invention provides an interactive play structure for facilitating team-oriented or group interactive play to achieve a common goal. The play structure includes a number of play elements disposed at various locations and elevations throughout the play structure. Each play element can be activated or operated by one or more play participants to complete one of several necessary steps in a chain of triggering events in which kinetic energy is transferred from one play element to the next. The overall completion of the chain of events results in a common desired result or effect, such as a domino-like cascade of various mechanisms, balls, water and/or the like. Play participants achieve the final goal through a collective team effort requiring the coordinated completion of several smaller objectives comprising each necessary step in the chain of triggering events.

In accordance with another embodiment the present invention provides an interactive play structure in the form of a human-sized Rube Goldberg contraption in which play participants can operate any one of a number of play elements to complete one of several steps in a chain of events transferring sufficient kinetic energy to achieve a desired end result, such as the spilling of a giant bucket of water. Play elements may include various, gear systems, pulleys, conveyers, balance beams, water wheels, windmills and any other suitable devices or mechanisms capable of receiving or transferring kinetic energy. One or more human-sized "squirrel cages" or treadmills may also be provided to allow play participants to generate sufficient kinetic energy to operate one or more of the play elements. The play structure can be implemented in any one of a number of desired themes, such as a gigantic clock or factory assembly line, or the like.

In accordance with another embodiment the present invention provides an interactive play structure which combines elements and aspects associated with both wet and dry play structures to exploit the best qualities of both and to create a wide variety of new and exciting play elements and effects otherwise unattainable with wet or dry play mediums, alone. Suitable play elements may include valves, springs, cams, pulleys, gears, cogs, baskets, buckets, and the like, as well as various water/air-powered devices, such as windmills, waterwheels, water or pneumatic-activated ball lifting conveyers, water or pneumatic-operated balance beams and the like.

These and other advantages and features of the present invention will become readily apparent to those skilled in the art from the following detailed description of the preferred embodiments, having reference to the accompanying drawings, the invention not being limited, however, to any particular preferred embodiment disclosed.

DETAILED DESCRIPTION OF THE PREFERRED EMBODIMENTS

Figure 1:
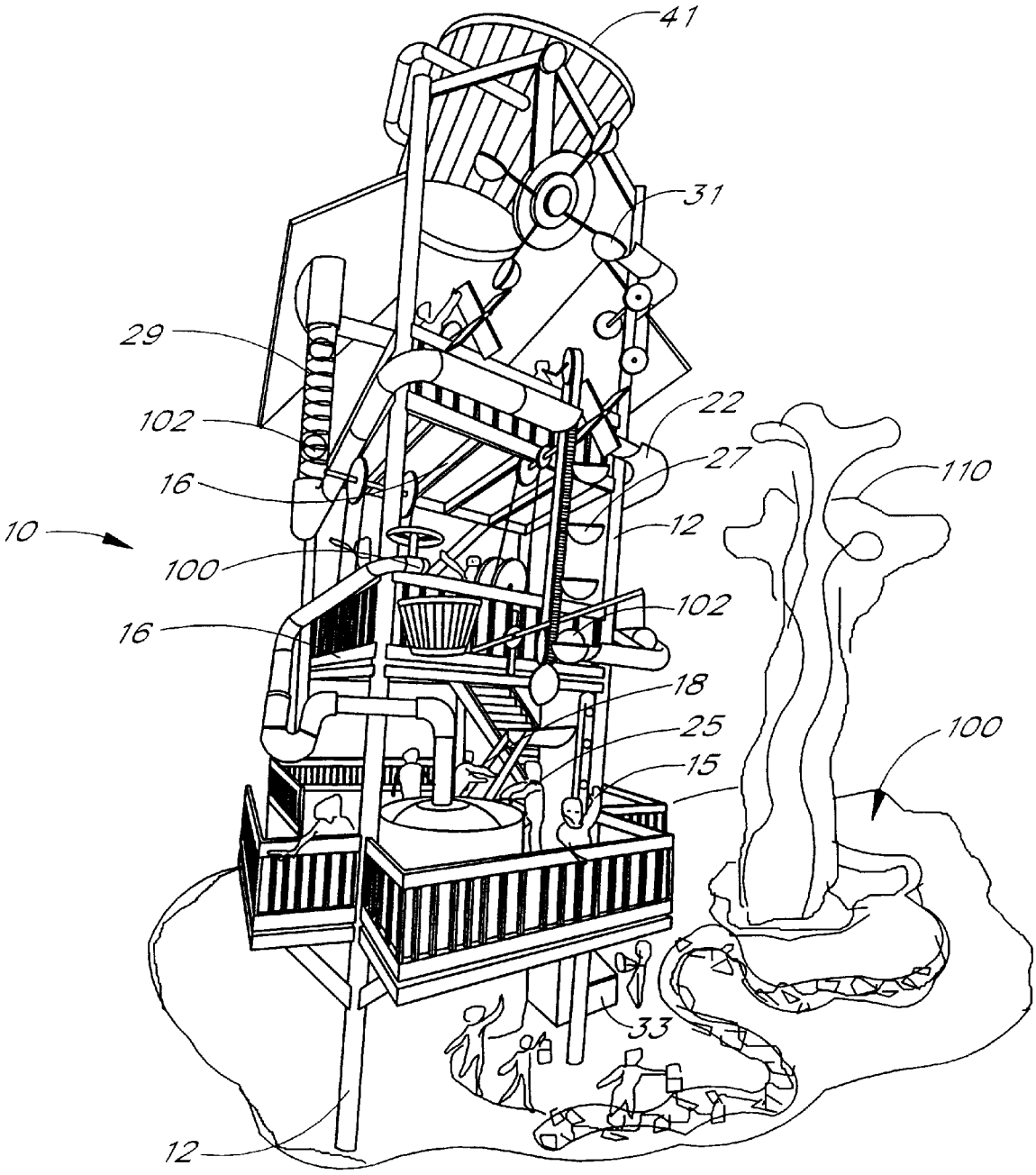
FIG. 1 is a perspective view of a kinetic interactive play structure having features and advantages of the present invention.

FIG. 1 is a perspective view of one preferred embodiment of a kinetic interactive play structure 10 having features and advantages in accordance with the present invention. The particular interactive play structure shown is provided in the theme of a gigantic human-sized Rube Goldberg contraption with water 100 and balls 102 providing familiar and entertaining play mediums. Of course, those skilled in the art will readily appreciate that the present invention may be implemented in accordance with a wide variety of other possible embodiments and exciting play themes using any combination of familiar and fun play media. For example, a factory floor assembly line, island tree house, lost temple or fire station can each provide an exciting play theme for an interactive play structure having features and advantages as taught herein.

The play structure is configured such that play participants 15 can operate any one of a number of play elements (25, 27, 29, 31, 33) to complete one of several steps in a chain of events resulting in a transfer of kinetic energy at each step. Each play element has a sequential position in the chain of events such that its operation must be coordinated with the operation of other play elements by other play participants in order to complete the overall task. Thus play participants 15 must work together in a collective team effort requiring the coordinated completion of several smaller objectives comprising each necessary step in the chain of triggering events. Once all of the individual steps are completed in the proper order the desired end result is brought about, such as spilling of thousands of gallons of water from a giant tipping bucket 41. Alternatively, the end result or desired effect may be a spectacular domino-like cascade of various mechanisms, balls, water and/or the like, each resulting in a release or transfer of kinetic energy or other energy from one mechanism to the next.

Suitable play elements may include a diverse variety of both "wet" and "dry" mechanisms and devices, such as a pump 25, ball elevator 27, spiralling ball chute 29, pin wheel ball drop 31, water conveyer 33, gear systems, ramps, pulleys, conveyers, balance beams, water wheels, windmills and any other suitable device or mechanism capable of receiving or transferring energy. One or more human-sized "squirrel cages" or treadmills (not shown) may also be provided to allow play participants 15 to generate sufficient kinetic energy to operate a pump or conveyer or one or more other play elements. Preferably, play participants 15 supply the actuating power or kinetic energy required to operate each of the play elements and to achieve the final desired effect. Of course, those skilled in the art will readily recognize that extrinsic power sources may also be used to provide some or all of the energy needed to operate a particular play element or create a desired effect.

Suitable play media may include, without limitation, such diverse items as water, tennis balls, foam balls, rubber balls, beach balls, balloon balls, bowling balls, Frisbees™, foam darts/arrows, snow, mud, water-balloons, Slime™, and a wide variety of other fun and exciting play media capable of receiving or transferring kinetic energy. Durable plastic or rubber play media are preferable in an outdoor play structure where environmental exposure may prematurely destroy or degrade the quality of certain play mediums such as foam balls.

Again, the present invention advantageously provides an interactive play structure which combines various elements and aspects associated with both wet and dry play in order to exploit the best qualities of both and to create a wide variety of new and exciting play elements and effects otherwise unattainable with wet or dry play mediums alone. In a particularly preferred embodiment, the play media may comprise relatively large, heavy balls 102 ranging in diameter from approximately 6 to 12 inches and, more preferably, about 8 inches. The weight of the balls 102 is preferably at least about 3–10 pounds and, more preferably, about 6 pounds, in order to provide significant storage and release of kinetic energy at relatively slow velocities. Of course balls of other weights and sizes may also be used, but are preferably not so large or heavy as to create structural difficulties in supporting the balls or difficulties in being manipulated by play participants. It should be understood that the present invention is not limited to any particular preferred play media.

The overall play structure 10 generally comprises a supporting framework 12 defining a multi-level structure. This may be fabricated using any one of a number of suitable materials and construction techniques well known to those skilled in the art. The play structure 10 may be used for either outdoor or indoor use, as desired, and materials and construction techniques should be selected accordingly. The supporting framework 12 may be formed from a plurality of interconnected support members, comprising columns, pylons, beams, connectors and the like. The individual support members may be formed from any variety of convenient materials having sufficient strength and durability for safely supporting multiple play participants and the play elements. For example, support members formed of plastic or PVC pipes, steel pipes, I-beams or channel beams, reinforced concrete beams/columns, wooden beams and the like may all be used to form the supporting framework 12.

A number of platforms 16 are preferably supported by the supporting framework 12 at various desired elevations with respect to ground level. The platforms 16 define various play areas. The platforms 16 are preferably of similar shape and dimension such that they can be assembled in a modular fashion, as shown. Mating 4'×4' square platforms and 4'×8' rectangular platforms may be used to construct a variety of play structures similar to the preferred embodiment shown in FIGS. 1. Advantageously, the modular construction as taught herein allows a wide variety of play structures 10 to be formed from a collection of standard support members and platforms 16 which may be interconnected on-site to create a play structure of virtually any desired shape, size, or height. Alternatively, it is envisioned that any one of a number of other suitable modular or non-modular shapes and sizes of platforms may be used, including without limitation, triangles, pentagons, hexagons and/or trapezoids.

Platforms 16 are preferably stacked or staggered in elevation, as shown in FIG. 1, such that play participants can climb from one platform 16 to the next. Stairs 18 may be provided for access between various platforms 16. The various platforms 16 may also incorporate various accessways in the form of passive play elements, such as climbing nets, crawl tunnels, swinging bridges, slides, and the like. These provide entertaining physical challenges and allow play participants to safely negotiate their way through the various levels and platforms of the play structure. Crawl tunnels may be constructed of any variety of suitable materials such as clear plastic or fiberglass, or, more preferably, they may be constructed of a soft webbing or net material. Tunnels may terminate next to a slide or they may lead to another area of the structure, as desired.

For visual appeal and added safety, optional decorative panels, railings 20 and/or roofing elements may be provided, as desired, to shade play participants from the sun (for outdoor play structures), to prevent play participants from falling off the structure, or to complement a particular desired theme of the play structure. The panels, railings, or roofing elements may be formed of any suitable material such as wood, fiberglass or other reinforced fiber, PVC, aluminum, steel or a variety of other materials, as desired. Corrosion-resistant materials are preferred if the play structure is to be used outdoors. Of course, those skilled in the art will readily appreciate that a wide variety of other decorative or thematic elements may be incorporated into the overall design of the play structure in order to provide added safety and/or to help convey a particular desired play theme. The use of hand rails, enclosure panels, and non-slip surfaces provides added safety in order to protect play participants 15 from possible injury.

A number of conduits 22, channels, tracks, or the like are provided throughout the play structure 10 for safely transporting play media to and from the various play elements disposed throughout the play structure. The conduits 22 may be formed from plastic or PVC pipes joined together using commercially available fittings, as is well known in the art. Conduits 22 may also be formed from a wide variety of other suitable materials such as steel pipe, ceramic/clay pipe, or they may be formed as open or enclosed channels, rails and/or runners, as desired. In a particularly preferred embodiment, play media in the form of large, heavy balls 102 may be transported throughout the play structure 10 using a three point track or rail system such that the ball cannot be dislodged from the track. This is desirable to prevent injuries to play participants 15 and also ensures the proper functioning of the play structure 10 and the various associated play elements. Alternatively, the tracks or rails may be completely or partially enclosed such that the balls 102 cannot be handled by play participants. One method of enclosing may be to use a clear plexiglass cover so that the visual appeal of the moving play media or balls is not lost. Of course, conduits or enclosures having different colors and/or shapes may also be used, as desired, to accommodate the beneficial use of various play media. Play media may also be transported by use of pressurized air, pressurized water, gravity or other suitable means, as desired.

While a particular preferred structure has been described, it will be readily apparent to those skilled in the art that a wide variety of other possible framing designs and construction techniques may be used to create the supporting framework 12 for a play structure 10 having features and advantages of the present invention as taught herein. For instance, the supporting framework 12 may be constructed entirely or partially of molded or contoured concrete, fiberglass or plastic, as desired. Alternatively, the supporting framework may be constructed entirely or partially from conduits 22, which also transport play media to and from various locations throughout the play structure 10.

Figure 2:
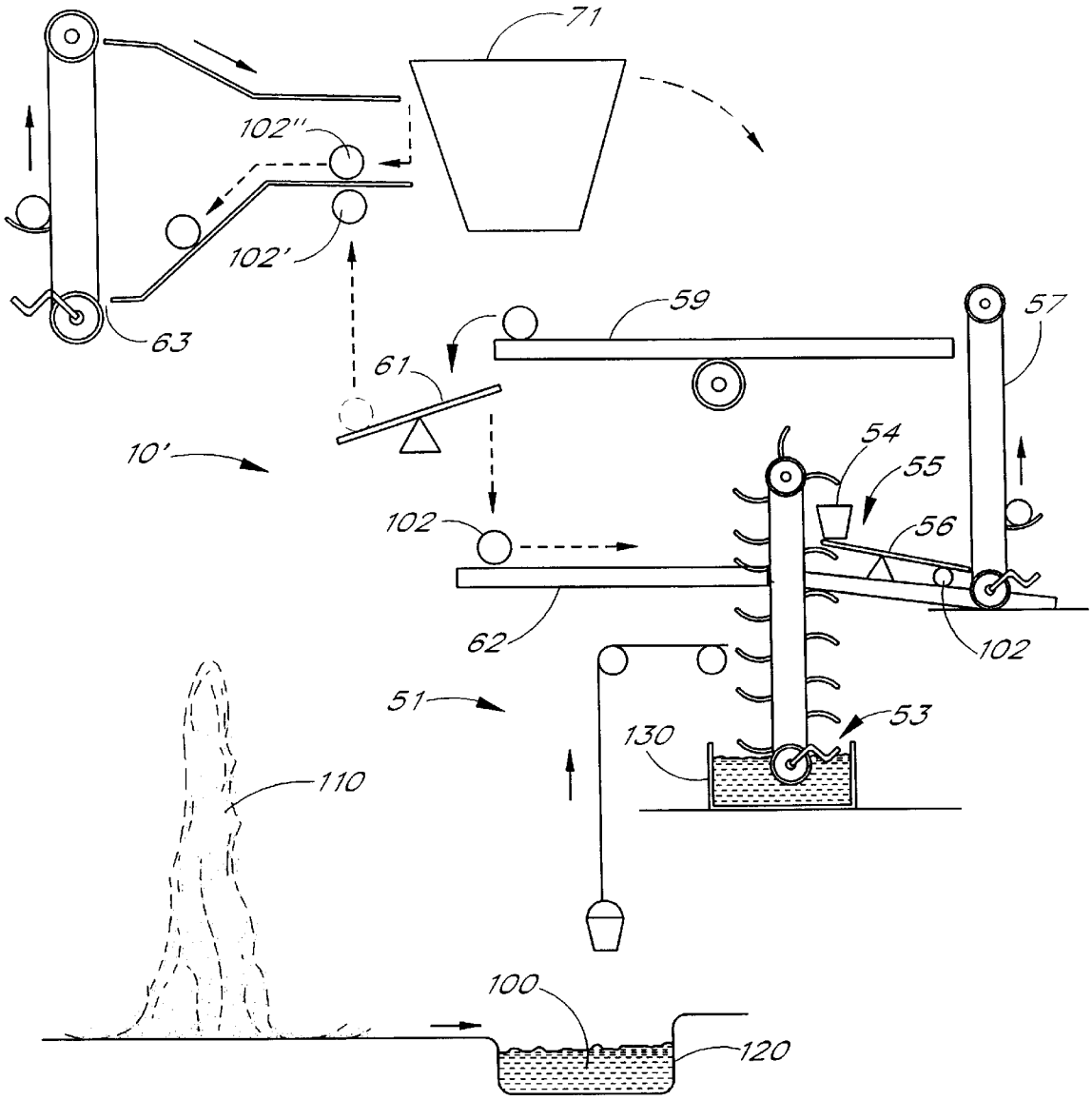
FIG. 2 is a schematic drawing illustrating one possible mode of operation of an interactive play structure having features and advantages of the present invention.

FIG. 2 is a schematic drawing illustrating one possible mode of operation of an interactive play structure 10' having features and advantages of the present invention. The play structure 10' utilizes water 100 and balls 102 as the primary play mediums and incorporates a number of play elements (51, 53, 55, 57, 59, 61, 63) disposed among three different levels, as shown.

In operation, a water geyser 110 provides water 100 to a first reservoir 120. Play participants utilize a water bucket and pulley system 51 to transfer water 100 from the first reservoir 120 to a second reservoir 130. A play participant operated bucket conveyer 53 elevates water from the second reservoir 130 and dumps it into a bucket 54 comprising part of a water-activated gate device 55. When the water in the bucket 54 reaches a predetermined level, the plank 56 tilts counter-clockwise, allowing a ball 102 to roll to a pick-up point of a ball conveyer 57. Play participants then turn a crank on the ball conveyer 57 to hoist the ball 102 upward onto a ball balancing beam 59. By turning another crank on the ball balancing beam 59 play participants can cause the balancing beam 59 to tilt counter-clockwise allowing the ball 102 to roll down the beam gaining kinetic energy. At the end of the beam 59 the ball drops off onto the end of a teeter-totter 61 transferring its kinetic energy to a second ball 102' disposed on the opposite end of the teeter-totter 61. The first ball 102 returns via a ball return 62 to its initial starting point adjacent the water-activated gate device 55. The second ball 102' is propelled upward, striking yet a third ball 102", dislodging it from its perch on a lower inclined ramp 62 of another ball conveyer 63. Play participants then turn another crank to hoist the third ball 102" up to an upper inclined ramp 64, whereupon the ball rolls down and transfers kinetic energy to the big bucket 71 or an associated triggering device causing it to spill its contents and optionally triggering yet other cascading effects.

Figure 3:
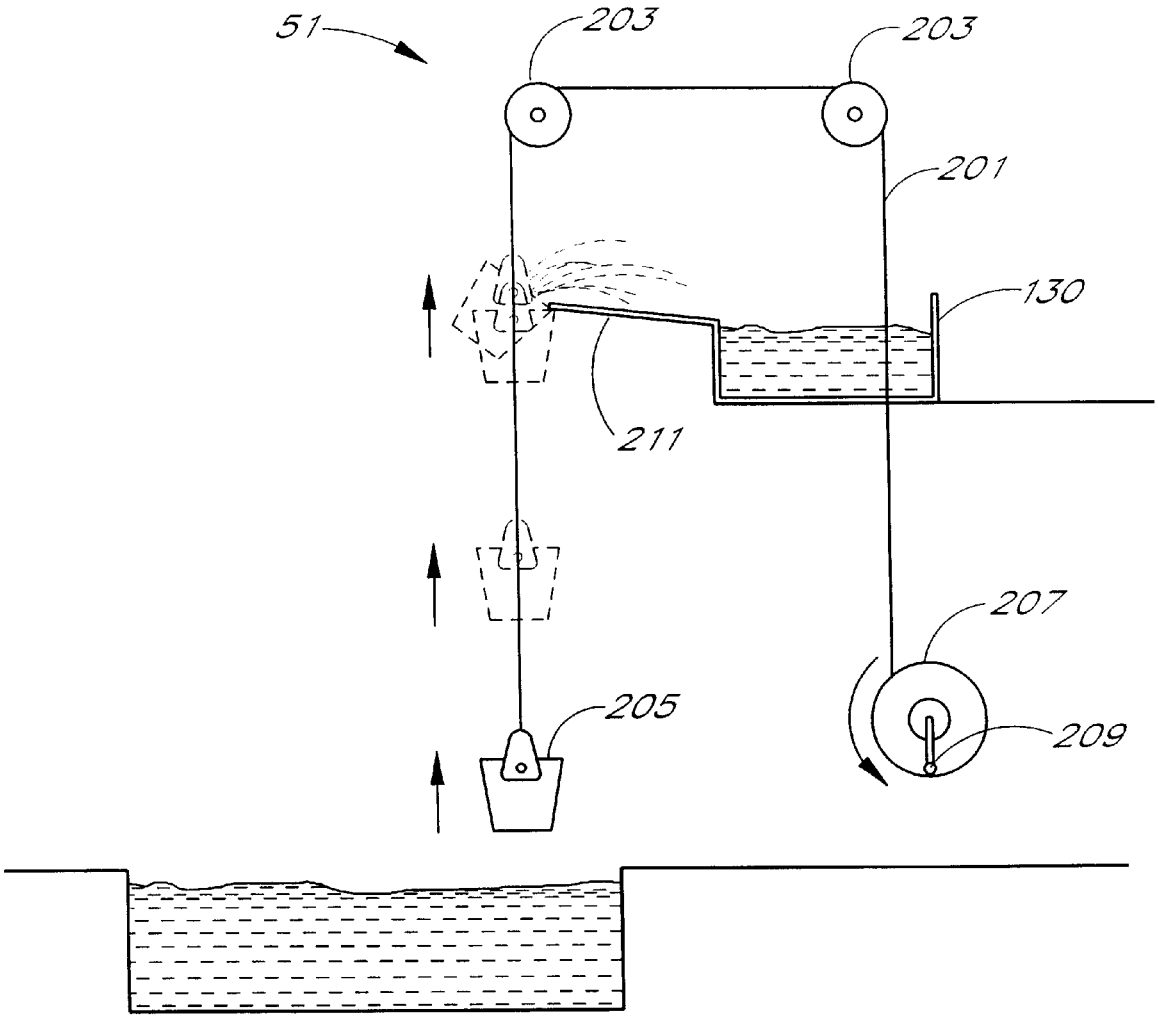
FIG. 3 is a front elevational view of an interactive play element having features and advantages of the present invention in the form of a water bucket and pulley system, illustrating one possible mode of operation thereof.

It will be understood that the various play elements and effects comprising the interactive play structure 10, 10' have been shown and described by way of illustration only. Those skilled in the art will recognize that there are numerous ways to implement the various play elements and effects described herein using well know materials and construction techniques. For example, and as shown in FIG. 3, the water bucket and pulley system 51 may comprise a rope 201, pulleys 203, and a hinged bucket 205. The rope 201 may be wound around a spool 207 connected to a crank 209. Play participants can either pull the rope 201 or turn the crank 209 to raise and lower the bucket 205 from the first reservoir 120 to the second reservoir 130. A spill lip 211 may optionally be provided to cause the bucket 205 to spill its contents when it reaches a certain height. It will be recognized by those skilled in the art that many other variations of this device may also be used.

Figure 4:
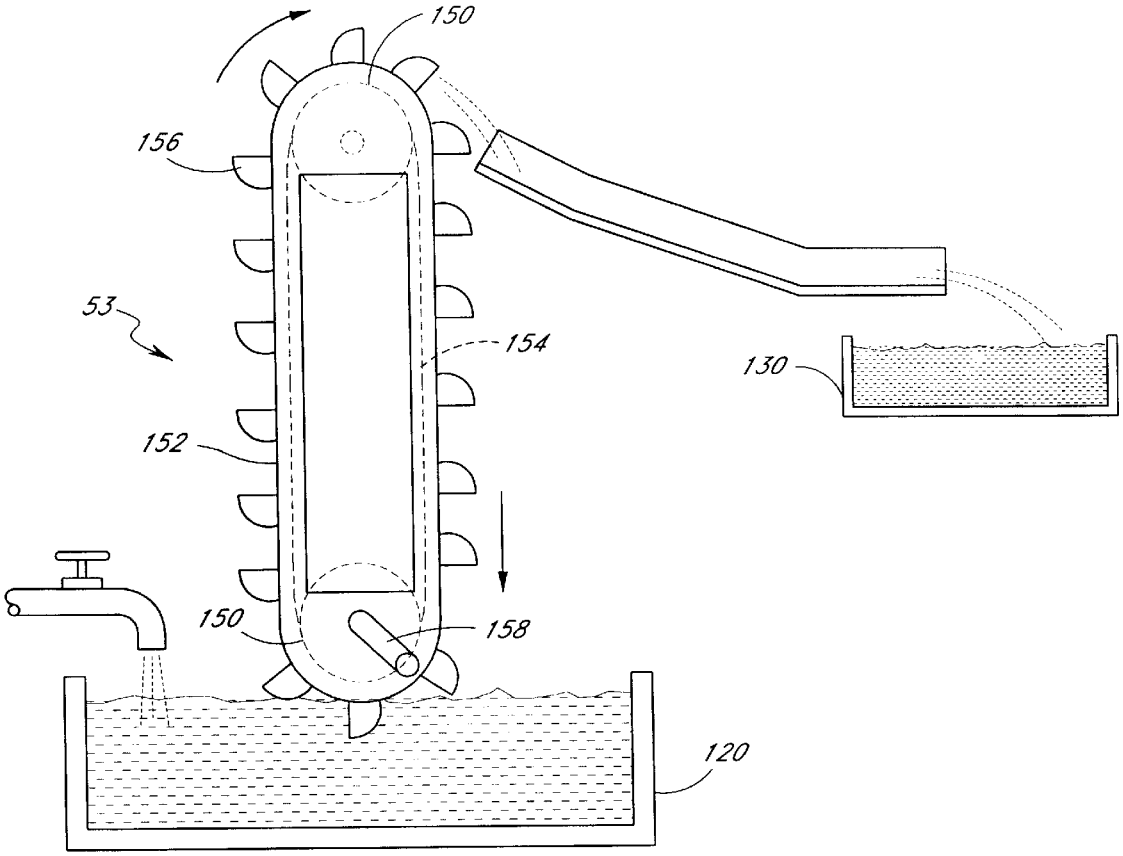
FIG. 4 is a front elevational view of an interactive play element having features and advantages of the present invention in the form of a water bucket conveyer, illustrating one possible mode of operation thereof.

As shown in FIG. 4, the bucket conveyer 53 may comprise a continuous chain of buckets 156 attached to a rubber or plastic belting 154. Individual buckets 156 scoop up water or other play media from the lower reservoir 120 and carry it upward. The plastic buckets 156 are attached to the plastic or rubber belting 154 at regular intervals such that water may be elevated almost continuously by successive buckets 156. The bucket conveyer 53 lifts play media vertically until the end of the bucket elevator span is reached. As each bucket 156 passes over the upper end of the conveyor span, it empties its contents into the upper reservoir 130. The buckets 156 may be formed of plastic, rubber or other suitable material. The plastic or rubber belting 154 forms a continuous loop about sprockets 150. A crank 158 may be used to supply operating energy to the conveyer 53 as will be readily understood by those skilled in the art. Optional idler sprockets or rollers (not shown) may be intermittently located throughout the conveyer span for support, if necessary. Play media is thus transferred between two play elements. Of course, various other means known to those in the art to power a conveyor may also be used, such as treadmills, bicycles, hand cranks, gearing, and the like. Ball conveyers 53, 63 operate in substantially the same way, except that the buckets 156 are replaced with scoops of sufficient size and shape to carry balls 102.

Figure 5A:
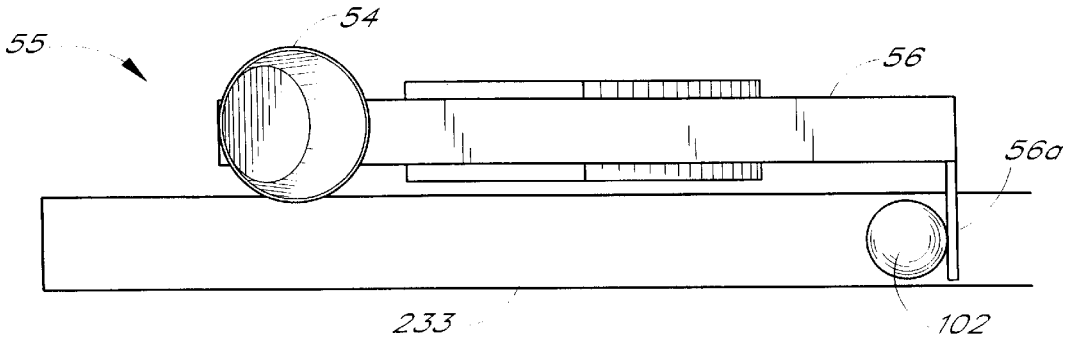
FIG. 5*a* is a top plan view of an interactive play element having features and advantages of the present invention in the form of a water-activated gate device.
Figure 5B:
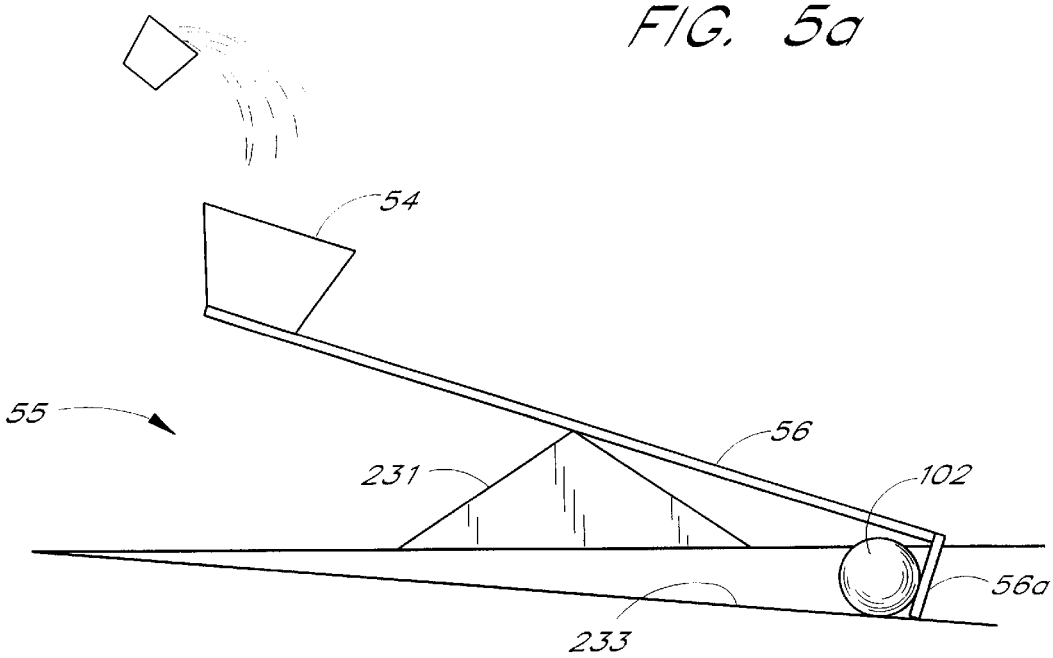
FIGS. 5*b*–5*c* are time-sequenced front elevational views of the water-activated gate device of FIG. 5*a*, illustrating one possible mode of operation thereof.
Figure 5C:
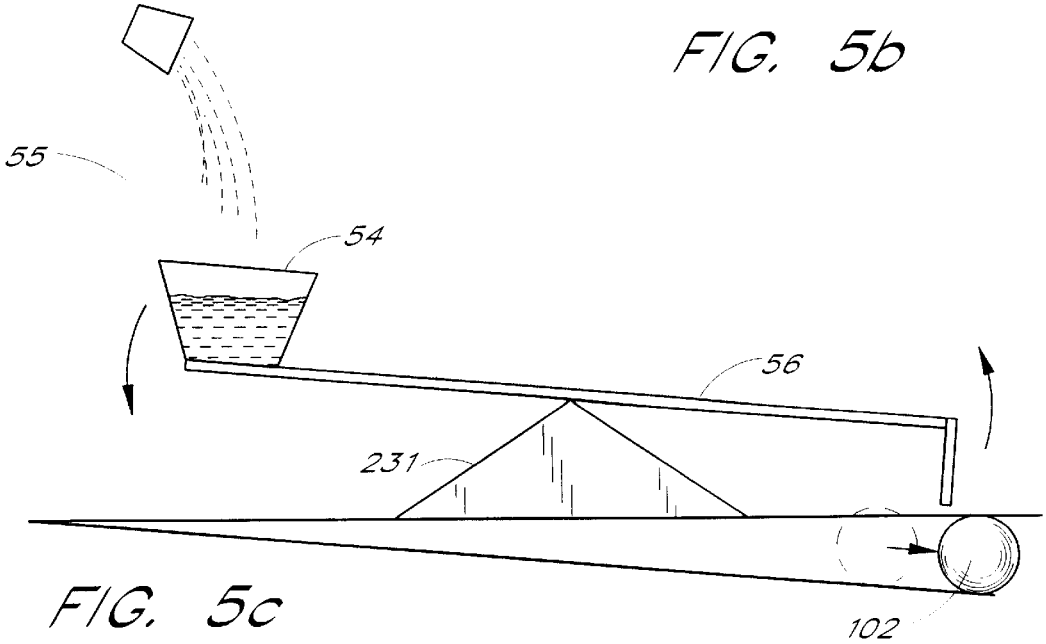

FIGS. 5*a*–5*c* show one possible embodiment of a water-activated gate device 55 having features and advantages in accordance with the present invention. In this embodiment the gate device 55 comprises a plank 56 resting on a fulcrum 231. On one end of the plank 56 is formed an optional gate extension 56*a*. A bucket or other water receptacle 54 is disposed on the opposite end of the plank 56. The location of the fulcrum 231 and/or the weight of the plank 56 and bucket 54 are preferably selected or adjusted such that when the bucket 54 is empty, the plank 56 is rotated fully clockwise so that the gate extension 56*a* prevents the ball 102 from rolling down an incline 233, as shown in FIG. 5*b*. When the bucket 54 is filled with water to a predetermined level, however, the plank 56 rotates counter-clockwise, allowing the ball 102 to roll past the gate extension 56*a*, as shown in FIG. 5*c*. The gate device 55 preferably resets automatically either by causing the bucket 54 to gradually leak its contents or by causing the bucket 54 to spill once it reaches its downward end of travel. Again, it will be recognized by those skilled in the art that many variations of this device are possible.

Figure 6A:
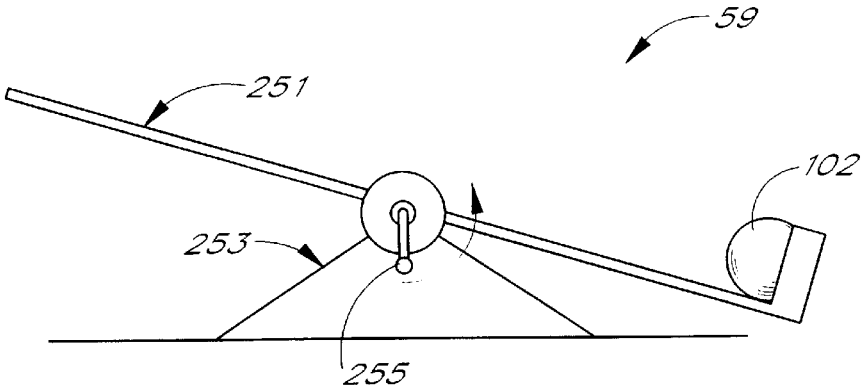
FIGS. 6*a*–6*c* are time-sequenced front elevational views of an interactive play element having features and advantages of the present invention in the form of a ball balancing beam, illustrating one possible mode of operation thereof.
Figure 6B:
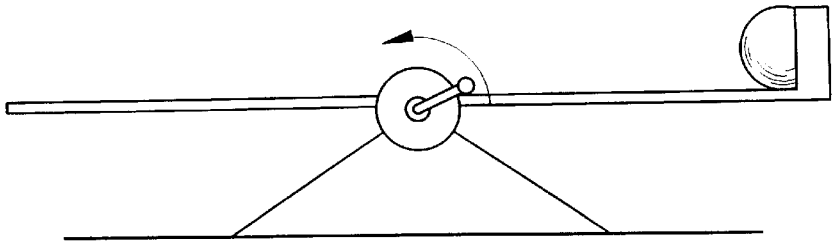
Figure 6C:
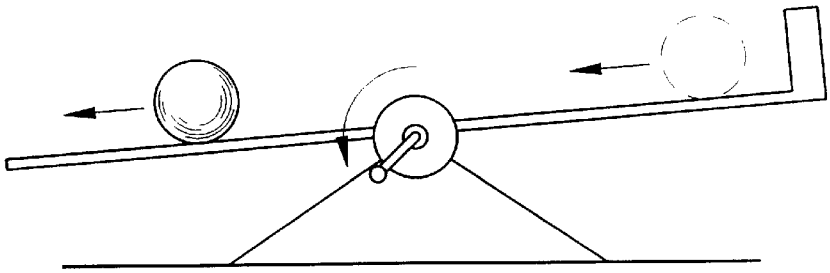

FIGS. 6*a*–6*c* show one possible embodiment of a ball balancing beam 59. The balancing beam 59 comprises an adjustable ramp 251 pivotably connected to a fulcrum 253 by gearing (not shown) such that it can be tipped about the fulcrum point 608 in a clockwise or counterclockwise rotation. An actuator crank 255 may be turned by play participants to rotate the ramp clockwise to receive a ball 102. Once the ball 102 is received, the crank can be turned in the opposite direction to turn the ramp counter-clockwise, allowing the ball 102 to roll down the ramp, as shown in FIG. 6*c*.

Figure 7:
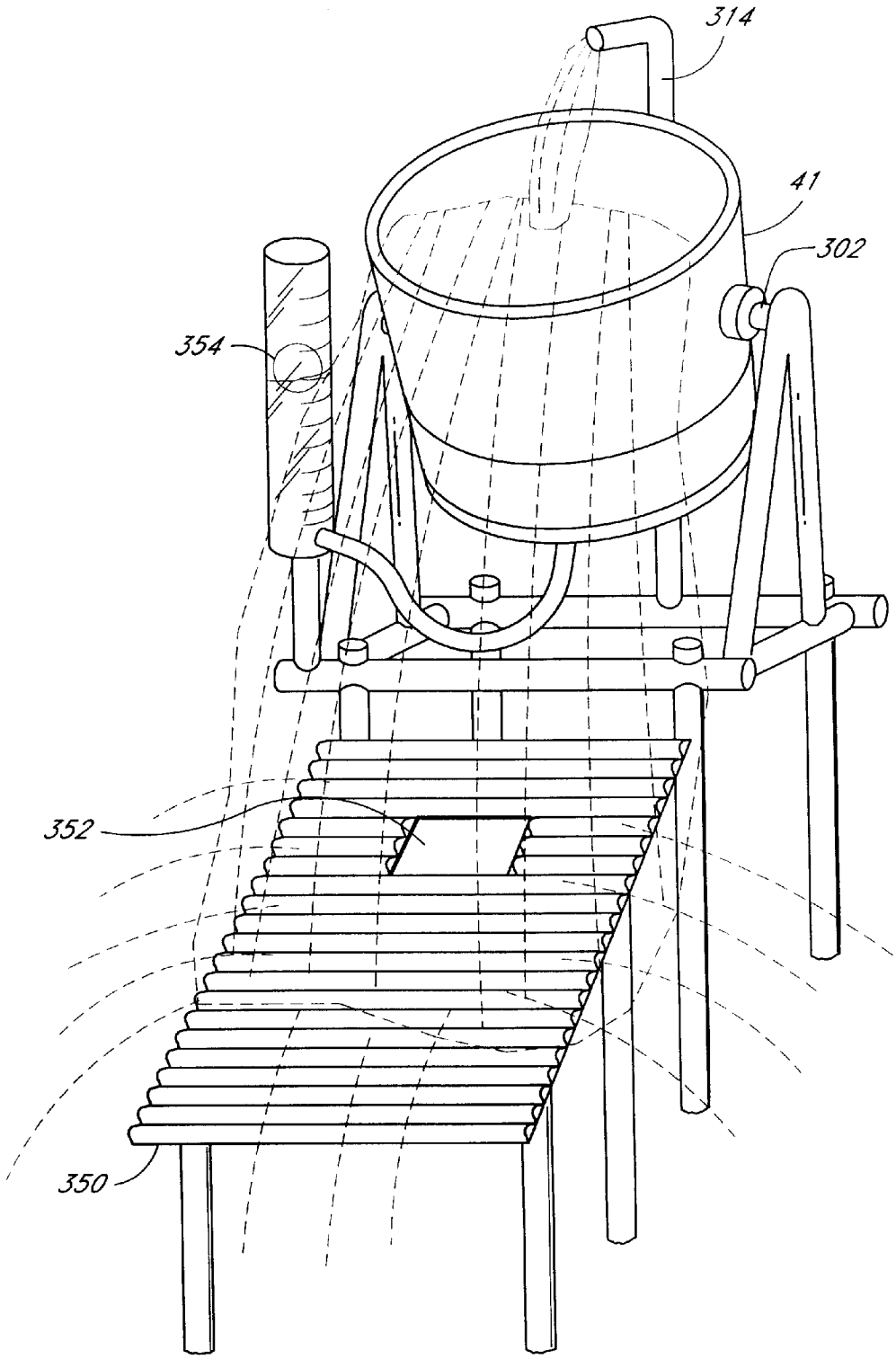
FIG. 7 is a perspective view of a tipping bucket play effect having features and advantages in accordance with the present invention.

FIG. 7 shows one possible embodiment of a giant tipping bucket 41 having features and advantages as taught herein. The bucket 41 is balanced on top of the play structure, as shown, and is adapted to periodically spill its contents of thousands of gallons of water onto play participants below in response to a triggering event, creating dramatic visual, aural and tactile effects. The bucket 41 is preferably about 10 to 100 feet tall and, more preferably, about 30 feet tall. The bucket 41 is pivotably mounted so as to be conditionally stable. In its stable condition, the pivot axis 302 is above the combined center of gravity of the bucket and the water contained in the bucket 41 such that the bucket maintains an upright orientation. When filled beyond a certain point, however, the combined center of gravity of the bucket 41 and the water contained in the bucket becomes elevated above the pivot axis 302, causing the bucket 41 to become unstable.

In one embodiment, a suitable latch (not shown) engages the bucket 41 to prevent it from tipping over when it is in its unstable condition. The latch is configured such that when a ball or other play media contacts a portion of the latch, it releases allowing the bucket 41 to spill. In an alternative embodiment, the ball or other play media can trigger the spilling of the bucket by transferring sufficient kinetic energy to upset the conditions for stability, thereby causing the bucket to tip. The conditions for stability and the direction of spilling can be controlled by selectively weighing the bucket 41 to slightly bias it forwards or backwards, as desired, or by mounting the bucket 41 slightly off-axis in order to bias it in a particular desired direction. After spilling its contents, the bucket 41 returns to a stable upright position.

The particular shape of the bucket 41 is relatively unimportant and may be varied, as desired, to accommodate different size play structures and/or to compliment a particular play theme. The size and capacity of the bucket 41 can also be varied, as desired, to achieve various desired effects having benefits and advantages as taught herein. A bucket 41 having a capacity of between about 100 and 3000 gallons should be adequate for most applications.

As illustrated in FIG. 7, the bucket 41 may be filled by water or other play media supplied by a pipe and spout 314.

Depending upon the desired effect, this flow of play media may either be passive-continuous, passive-intermittent, or partially or fully active (i.e., controlled by play participants). For passive-continuous flow, the bucket 41 fills up automatically at fairly regular intervals after it has been tipped. A limit switch or other such device may be used to shut off the flow once the bucket is filled to a predetermined level. Alternatively, play participants may cooperate to fill the bucket 41 using play participant-operated pumps, conveyers or other means. If desired, an optional water level indicator 354 may also be provided, as shown, for indicating the level of water in the bucket 41.

When the bucket 41 tips, water contained in the bucket, preferably falls onto a deflection shield 350, as shown in FIG. 7. This causes the water to splash and disperse widely, creating dramatic visual and aural effects. The presence of the shield 350 also mitigates the direct impact of water on play participants. The size and shape of the deflection shield 350, the angle of orientation, and the particular materials used to construct the deflection shield 350 may be varied to create particular desired effects. Sheet metal awnings have been found to provide beneficial results for most applications.

For wet play, one or more optional openings 352 may be provided in the deflection shield 350, as shown, for allowing at least a portion of the spilling water to directly impact play participants standing on a platform immediately below the opening 352. Such openings 352 may either be fixed in size or they may be adjustable via a sliding door or similar device well known in the art. Preferably, the openings 352 are of sufficient size and shape to allow significant amounts of water to enter and splash about the play structure, but not so large as to allow injury to play participants. A single opening having an open area of between about 2–8 square feet provides an adequate compromise for most applications. Of course, larger or smaller openings having various other shapes and sizes may also be used, as desired. Optional baffles (not shown) may also be provided in the path of the spilling water through the opening in order to mitigate the direct impact on participants standing immediately below the opening.

Figure 8:
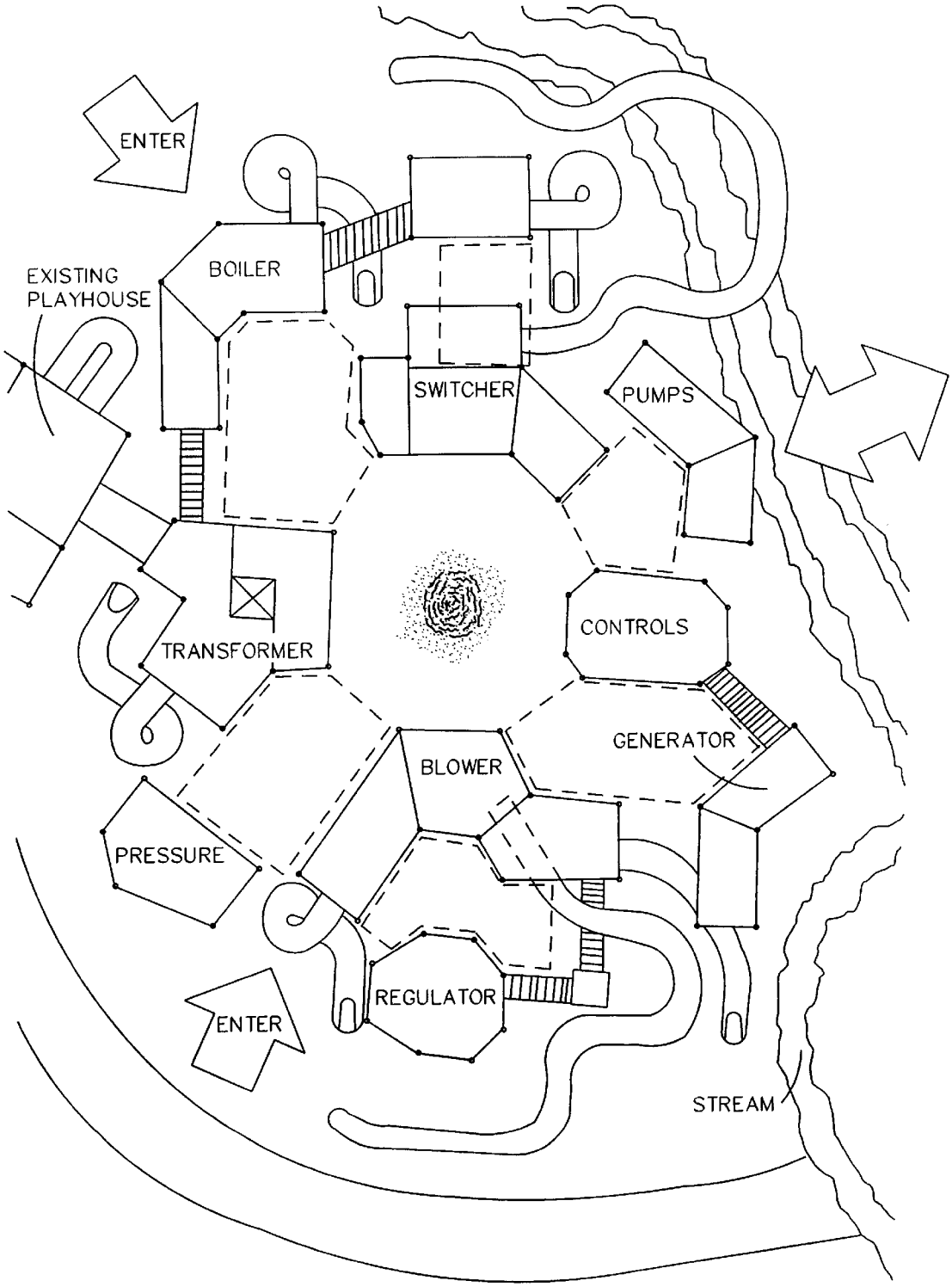
FIG. 8 is a top plan view of a large recreation center incorporating a plurality of interactive play structures having features and advantages in accordance with the present invention.

FIG. 8 is a top plan view of a large amusement or recreation center incorporating a plurality of interactive play structures 10" each having features and advantages in accordance with the present invention. If desired, these play structures can be interconnected with one another and/or with other play structures such that operation of each play structure changes over time, depending upon its interaction with other play structures. Multiple play structures may be operated in parallel such that groups of play participants can compete with one another to achieve a desired end result. In this manner, groups of play participants are rewarded when they cooperate and work as an efficient team to achieve a common goal. Multiple interactive play structures may also be linked together to create a giant factory or assembly line having different "manufacturing lines" each with a different type of play media and play elements requiring different skills and problem solving abilities. Again, the possibilities for unique group and interactive play are virtually unlimited.

It will be appreciated that these and other advantages and features of the present invention will be attainable by those persons skilled in the art using ordinary skill and applying the teachings contained herein. Although the present invention has been disclosed in the context of certain preferred embodiments, it will be understood by those skilled in the art that the present invention extends beyond the specifically disclosed embodiments to other alternative embodiments. Thus, it is intended that the scope of the present invention herein disclosed should not be limited by the particular disclosed embodiments herein, but should be defined only by a fair reading of the claims which follow.

What is claimed is:

1. A method for entertaining play participants, comprising the following steps:

providing a support frame upon which said play participants can climb and/or play;

providing one or more play-participant-activated play elements at various locations and/or elevations throughout said support frame and arranged in a predetermined sequence;

providing a triggering device adapted to receive a signal or energy from one or more of said play elements and being operable to trigger or increase the probability of a desired event or chain of events having visual, aural and/or aesthetic appeal; and allowing said play participants to activate one or more of said play elements in said predetermined sequence to activate said triggering device.

2. The method in accordance with claim 1 comprising the further step of actuating said triggering device and thereby spilling a bucket of water.

3. The method in accordance with claim 1 comprising the further step of actuating said triggering device and thereby causing a cascading effect comprising multiple events being triggered in succession and each event resulting in a transfer of kinetic energy to trigger the next event in the cascade.

4. A method of interactive play comprising the steps of:

allowing one or more play participants to enter a human-sized Rube Goldberg contraption, including a plurality of human-operated devices, such as squirrel cages, treadmills, conveyers, levers, pulleys, gears, balance beams, water wheels, windmills and/or other mechanical, electrical, pneumatic or hydraulic devices capable of receiving or transferring kinetic energy;

causing said one or more play participants to operate said one or more devices in succession or in a predetermined sequence to cause a desired event or chain or events to occur.

5. The method of claim 4 wherein said step of causing said one or more play participants to operate said one or more devices comprises providing a tipping plank.

6. The method of claim 4 wherein said step of causing said one or more play participants to operate said one or more devices comprises providing a human-powered squirrel cage.

7. The method of claim 4 wherein said step of causing said one or more play participants to operate said one or more devices comprises providing a water-activated gate.

8. The method of claim 4 wherein said step of causing said one or more play participants to operate said one or more devices comprises providing a play media operated latch.

9. The method of claim 4 comprising the step of causing said one or more play participants to operate two or more of said devices in succession and thereby spilling a bucket of water.

10. The method of claim 4 comprising the step of causing said one or more play participants to operate two or more of said devices in succession and thereby creating a cascading effect comprising multiple events being triggered in succession and each event resulting in a transfer of kinetic energy to trigger the next event in the cascade.

11. A method of group interactive play comprising the following steps:

providing a play structure having a support frame and one or more interactive play elements disposed at various locations and/or elevations throughout said support frame and one or more a triggering devices adapted to receive a signal or energy from one or more of said interactive play elements and being operable to trigger or increase the probability of a desired event or chain of events to occur having visual, aural and/or aesthetic appeal;

arranging or programming said one or more interactive play elements and/or triggering devices so that when said elements or devices are operated or activated in succession or in a predetermined sequence a desired event or chain of events is caused to occur; and allowing a group of play participants to access and climb on said play structure and to activate two or more of said interactive play elements in said succession or in said predetermined sequence in order to cause said desired event or chain of events to occur.

12. The method of claim 11 comprising the step of providing a play structure having a support frame comprising a plurality of interconnected water conducting conduits.

13. The method of claim 11 comprising the step of providing a play structure having a support frame comprising a plurality of non-water carrying framing elements.

14. The method of claim 11 wherein said step of arranging or programming includes the step of arranging or programming at least one interactive play element comprising a tipping plank.

15. The method of claim 11 wherein said step of arranging or programming includes the step of arranging or programming at least one interactive play element comprising a tipping tank.

16. The method of claim 11 wherein said step of arranging or programming includes the step of arranging or programming at least one interactive play element comprising a human-powered squirrel cage.

17. The method of claim 11 wherein said step of arranging or programming includes the step of arranging or programming at least one interactive play element comprising a water-activated gate.

18. The method of claim 11 comprising the step of causing said one or more play participants to operate two or more of said interactive play elements in succession thereby spilling a bucket of water.

19. The method of claim 11 comprising the step of causing said one or more play participants to operate two or more of said interactive play elements in succession thereby creating a cascading effect comprising multiple events being triggered in succession and each event resulting in a transfer of kinetic energy to trigger the next event in the cascade.

20. A method of group interactive play comprising the steps of:

providing a plurality of play-participant-activated play elements at various locations and/or elevations throughout a play structure, each said play element being adapted to impart or transfer kinetic energy to other play elements or to an intermediate play media;

providing at least one triggering device adapted to receive a signal or energy from one or more of said play elements or said play media and being operable to trigger or increase the probability of a desired event or chain of events occurring having visual, aural and/or aesthetic appeal;

arranging or programming said play elements so that when two or more of said play elements are successfully operated in a predetermined sequence they cause said at least one triggering device to actuate said desired event or chain of events; and allowing a group of play participants to access said play structure and to activate said play elements in said predetermined sequence to cause or increase the probability of causing said desired event or chain of events.

* * * * *